US012722839B2

(12) United States Patent
Findeisen

(10) Patent No.: US 12,722,839 B2
(45) Date of Patent: Sep. 1, 2026

(54) CUP WITH PARTS: APPARATUS AND METHOD

(71) Applicant: Kurt Charles Findeisen, Los Angeles, CA (US)

(72) Inventor: Kurt Charles Findeisen, Los Angeles, CA (US)

( * ) Notice: Subject to any disclaimer, the term of this patent is extended or adjusted under 35 U.S.C. 154(b) by 0 days.

(21) Appl. No.: 18/677,060

(22) Filed: May 29, 2024

(65) Prior Publication Data

US 2024/0400250 A1 Dec. 5, 2024

Related U.S. Application Data

(60) Provisional application No. 63/470,129, filed on May 31, 2023.

(51) Int. Cl.

| | |
|---|---|
| ***B65D 3/06*** | (2006.01) |
| ***B65D 43/02*** | (2006.01) |
| ***B65D 55/16*** | (2006.01) |
| ***B65D 65/46*** | (2006.01) |

(52) U.S. Cl.

CPC ..... *B65D 3/06* (2013.01); *B65D 43/0202* (2013.01); *B65D 55/16* (2013.01); *B65D 65/466* (2013.01); *B65D 2543/00046* (2013.01); *B65D 2543/00092* (2013.01); *B65D 2543/00351* (2013.01); *B65D 2543/0049* (2013.01); *B65D 2543/00574* (2013.01)

(58) Field of Classification Search

CPC ..... B65D 3/06; B65D 43/0202; B65D 55/16; B65D 65/466; B65D 2543/00046; B65D 2543/00092; B65D 2543/00351; B65D 2543/0049; B65D 2543/00574; B65D 2231/022; B65D 1/265; B65D 2543/00537; B65D 2543/00638; B65D 2543/00509; B65D 81/3869; A47G 19/16; A47J 31/06

USPC ..... 229/404, 400, 906.1, 125.25; 220/716, 220/711; D7/396.2

See application file for complete search history.

(56) References Cited

U.S. PATENT DOCUMENTS

| | | | | |
|---|---|---|---|---|
| 3,806,023 | A * | 4/1974 | Barnett | B65D 51/00 229/404 |
| 4,872,569 | A | 10/1989 | Bolte | |
| 5,524,817 | A | 6/1996 | Meier | |
| 5,775,205 | A * | 7/1998 | Melton | A47J 31/06 99/279 |
| 6,109,518 | A | 8/2000 | Mueller | |
| 7,699,216 | B2 | 4/2010 | Smith | |
| 8,701,914 | B1 | 4/2014 | Buck | |

(Continued)

*Primary Examiner* — Christopher R Demeree

(74) *Attorney, Agent, or Firm* — J. Curtis Edmondson; Law Office of J Curtis Edmondson

(57) ABSTRACT

A cup with parts apparatus and method comprising the parts and the steps to create a recyclable/reusable/biodegradable (environmentally-friendly) disposable cup that boosts the circular economy. To aid adoption within a competitive marketplace, the cup is comparable with the industry standard: inexpensive to purchase, ship, and use at a beverage-selling social venue. One of the parts is a cup-shaped form (assembled by hand or machined) with which another liquid-retaining part can be assembled therewith to construct a drinking vessel. In a disassembled state, the light and durable parts are simple to reuse and provide cost benefits versus the industry-standard disposable cups (i.e., build-in lid, no need for a straw), which helps with adoption.

7 Claims, 7 Drawing Sheets

(56) References Cited

U.S. PATENT DOCUMENTS

| | | | | |
|---|---|---|---|---|
| 11,001,421 | B1 * | 5/2021 | Findeisen | B65D 1/265 |
| 11,008,131 | B2 * | 5/2021 | Herman | B65D 3/20 |
| 2007/0029320 | A1 * | 2/2007 | Bouie | B65D 1/265 220/23.86 |
| 2010/0288827 | A1 * | 11/2010 | Booth | B65D 43/022 229/404 |
| 2012/0165170 | A1 | 6/2012 | Wischusend, III | |

* cited by examiner

CUP WITH PARTS: APPARATUS AND METHOD

CROSS-REFERENCE TO PRIOR APPLICATION

This application claims the benefit of U.S. Provisional Patent Application No. 63/470,129, entitled as "Cup With Parts: Apparatus & Method", filed May 31, 2023, which is incorporated by reference in its entirety.

BACKGROUND

Plastic-lined paper disposable cups provide many benefits compared to the glass bottles they largely replaced (i.e., lighter and shatterproof). However, a drawback is currently very glaring: unlike glass, the liquid-retaining paper material is not optimal for recycling.

When considered separately, abundant varieties of paper and plastic are recyclable/reusable/biodegradable. This triumvirate description is widely considered environmentally friendly. In an unfortunate result, when paper is lined with plastic to create a liquid-retaining material for disposable containers, it becomes not optimally recyclable.

A tenet of the circular economy is reusability. The height of environmental friendliness is when items are reused many times. In the context of a fill-yourself beverage purchase, removing the need to provide a cup (the customer brings their own) results in cost and waste reduction, a win-win situation for both parties. One big hurdle here (there are others) is that standard cups are cumbersome to carry for most customers at most times. Yes, it is done, but in numbers that can surely be bested. In other words, there is room for social venues to adopt a disposable cup that fits more robustly into the circular economy.

Another big hurdle for the circular economy as it relates to beverage-selling social venues is the secondary role of disposable cups: They act as a periodic determinant of which customers have purchased a beverage. Trust is to be hoped for. Yet determining if customers who bring reusable cups have in fact paid to fill these cups is burdensome.

Disposable cups are costs that beverage-selling businesses assume to generate revenue. The current cost is relatively small, and competitive pressure keeps it thus. As a result, improvements to disposable cups that increase costs are less likely to be adopted.

A need is apparent for a light, shatterproof, and environmentally friendly disposable cup with an industry-standard cost parity to aid uptake. The solution is to use slight and durable parts that are not rendered environmentally unfriendly when brought together and constructed into a disposable cup. An added bonus is achieved by making reusability easier and subsequently more widely partaken in by beverage purchasers. This disposable cup must mirror the attributes of plastic-lined paper disposable cups: be of similar cost to purchase and ship; be easy to use by customers and employees alike; and require little, if any, set-up costs or associated machinery to use.

The field of disposable liquid containers includes U.S. Pat. No. 4,872,569 to Bolte and U.S. Pat. No. 5,524,817 to Meier and Kipp. The inventive subject matter of these patents is multiple-part assembled drinking vessels. The assembly of these vessels includes permanent adhesive steps, which reduces the viability of recycling. Also, they do not incorporate a lid, which is a cost savings that aids in industry adoption. Nor does the inventive subject matter provide realistic circular economy reusability capabilities.

U.S. Pat. No. 5,685,480 to Choi, and U.S. Pat. No. 6,109,518 to Mueller and Clauss also provide for multiple-part drinking vessels. However, they relate to insulating hot beverages in order to prolong warmth while simultaneously improving the hand feel. They do not include a lid. Nor does the inventive subject matter provide realistic circular economy reusability capabilities.

U.S. Pat. No. 7,699,216 B2 to Smith et al. provides for an insulating multiple-part drinking vessel for hot and cold beverages. Again, a lid is not incorporated. Nor does the inventive subject matter provide realistic circular economy reusability capabilities.

U.S. Pat. No. 8,701,914 B1 to Buck provides for a multiple-part drinking vessel with a focus on recyclability. Again, a lid is not incorporated. Nor does the inventive subject matter provide realistic circular economy reusability capabilities.

None of the aforementioned prior art describes a disposable cup that accomplishes all of the following: 1. Provides cost parity with or advantage over the industry standard (i.e., incorporates a lid, which also removes the need for a straw); 2. Has apparent circular economy reusability capabilities, or is recyclable/biodegradable; 3. Is easy to use by a layperson; 4. Fits in seamlessly with the industry-standard processes of social venues (e.g., restaurants, theaters, and theme parks); and 5. Requires little to no supporting machinery to operate.

SUMMARY

The inventive subject matter overcomes the aforementioned problems by providing a low-cost, light, durable, and easy-to-use disposable cup made from parts that remain recyclable/reusable/biodegradable, whether separate or assembled. The cup constructed from these parts functions just as a plastic-lined paper disposable cup. In addition, cost advantages that aid industry implementation are clear, for example: 1. Built-in lid with drinking hole that eliminates the need for a straw; 2. A liquid-retaining part that is easy to collapse into a reusable easy-to-transport item; 3. A part that social venues can provide that is low-cost and provides a marker of actual beverage purchase.

The inventive subject matter provides for a cup constructed from a cup-formed part (assembled by hand or machine) with a lip atop a bottom, and a grip and an aligned hole incorporated into an encasing side wall. Another part has a lid with a rim and a hole that is connected to a receptacle by a connecting band. To construct, the lid is threaded through the aligned hole. The rim is then folded over the lip where it engages with the grip to form a stronger hold between the parts. Liquid fills and is retained in the receptacle. Then the lid fits over the folded rim and the lip to provide cover. Drinking occurs via the hole. The parts can optionally be configured for carrying and reuse.

Another embodiment of the inventive subject matter provides for a cup constructed from a cup-formed part (assembled by hand or machine) with a lip atop a bottom, and an encasing side wall. Another part has a lid with a rim and a hole that is connected to a receptacle by a connecting band. To construct, the receptacle is inserted into the cup-formed part. The rim is then folded down over the lip. Liquid fills and is retained in the receptacle. Then the lid fits over the folded rim and the lip to provide cover. Drinking occurs via the hole. The parts can optionally be configured for carrying and reuse.

Another embodiment discloses a disposable cup assembly comprising an encasing part including a bottom, an encasing side wall extending upwardly from the bottom and having an aligned hole, a lip located at an upper edge of the encasing side wall; and a grip integrated into the encasing side wall. Various embodiments include a liquid-retaining part that includes a receptacle having a rim, a lid having a hole, the lid being attached to the receptacle via a connecting band, the lid is configured to be threaded through the aligned hole in the encasing side wall and the rim of the receptacle is foldable over the lip of the encasing part to secure the liquid-retaining part within the encasing part.

The disposable cup assembly of various embodiments includes the grip is a cut-out in the encasing side wall designed to engage with the folded rim of the receptacle to provide a secure connection. The disposable cup assembly of various embodiments includes the lip is a rolled lip to enhance the engagement between the folded rim of the receptacle and the encasing part. The disposable cup assembly of various embodiments has parts are formed from recyclable, reusable, or biodegradable materials. The disposable cup assembly of various embodiments includes a carrying case configured to encase the folded and flattened liquid-retaining part for storage and transport.

Other embodiments disclose a method of assembling a disposable cup that includes forming a cup shape by wrapping an encasing side wall around a bottom. The method may include threading a lid with a hole, which is attached to a receptacle via a connecting band, through an aligned hole in the encasing side wall. The method includes pulling the connecting band tight to secure the lid in place. The method may include folding a rim of the receptacle over a lip of the encasing side wall to secure the receptacle within the encasing side wall. In some embodiments, the method includes filling the receptacle with liquid and fitting the lid over the folded rim and the lip, wherein the hole in the lid is for drinking.

The method of further includes packing the liquid-retaining part in a carrying case for reuse after use. The method of may include providing parts are made from materials that are recyclable, reusable, or biodegradable. The method includes providing a grip to enhance the engagement between the folded rim of the receptacle and the encasing side wall. The method includes rolling the lip that provides an improved seal and connection between the parts.

Various embodiments include a disposable cup assembly that includes an encasing part that has a bottom, an encasing side wall extending upwardly from the bottom and a lip located at an upper edge of the encasing side wall. The disposable cup assembly may include a liquid-retaining part that has a receptacle having a rim, a lid having a hole, the lid being attached to the receptacle via a connecting band and the receptacle is insertable into the encasing side wall and the rim of the receptacle is foldable over the lip to secure the receptacle within the encasing part. The disposable cup assembly includes the encasing side wall includes a grip to enhance the engagement between the folded rim and the encasing part. The disposable cup assembly includes a carrying case configured to encase the folded and flattened liquid-retaining part for storage and transport.

This inventive subject matter relates to disposable cups. The various embodiments and domains described herein should not be construed as limitations in the potential application of the inventive subject matter. Rather they are teachings for the purpose of illustrating the ramifications and variations of possible embodiments of this inventive subject matter. These and other embodiments are described in more detail in the following detailed descriptions and figures.

The foregoing is not intended to be an exhaustive list of embodiments and features of the present inventive subject matter. Persons skilled in the art are capable of appreciating other embodiments and features from the following detailed description in conjunction with the drawings.

BRIEF DESCRIPTION DRAWINGS

The following figures show embodiments according to the inventive subject matter.

REFERENCE NUMERALS IN THE DRAWINGS

Figure 1A:
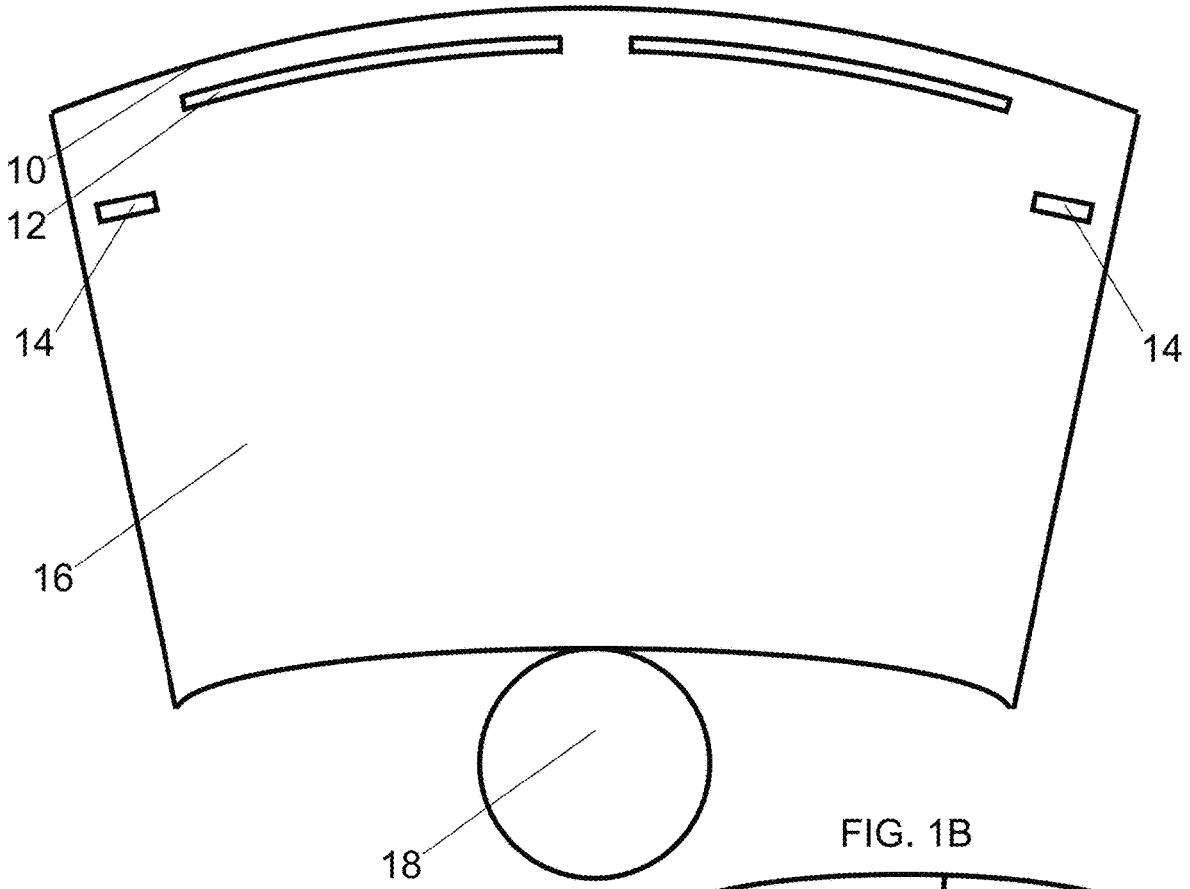
FIG. 1A is a front view of a part of the inventive subject matter unformed.

10 lip
12 grip
14 aligned hole
16 encasing side wall
18 bottom
20 receptacle
22 rim
24 connecting band
26 lid
28 hole
30 rolled lip
32 carrying case

DETAILED DESCRIPTION

Representative embodiments according to the inventive subject matter are shown in FIGS. 1 to 7. The specific embodiments are meant to be illustrative and not limit the scope of the inventive subject matter and the various ways it may be embodied.

In accordance with the present inventive subject matter, the cup with parts has: 1. A part with a lip atop a bottom; 2. On the same part, a grip and an aligned hole incorporated into an encasing side wall; 3. Another part with a receptacle with a rim that is attached to a lid with a hole via a connecting band. In another embodiment of the present inventive subject matter, the cup with parts has: 1. A part with a lip atop a bottom, and an encasing side wall; 2. Another part with a receptacle with a rim that is attached to a lid with a hole via a connecting band.

Figure 1B:
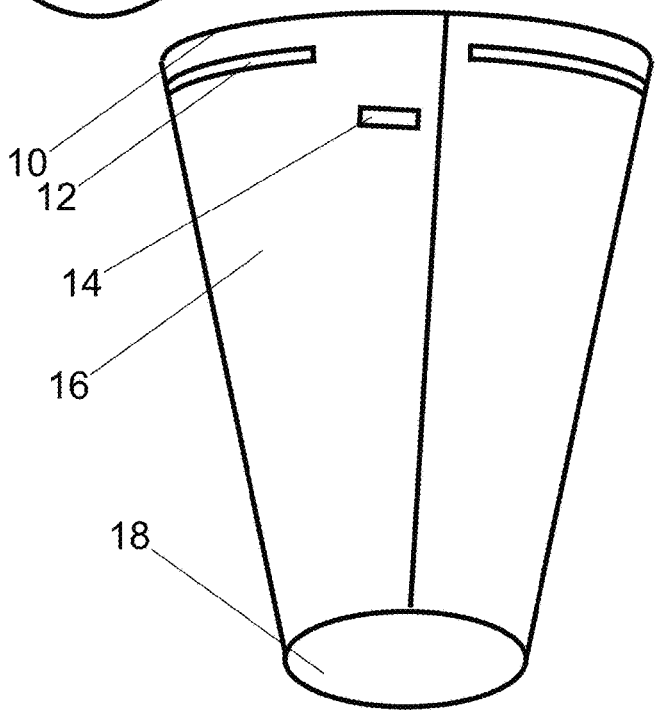
FIG. 1B is a perspective view of a part of the inventive subject matter formed (by hand or machine) into a cup shape.

FIGS. 1A & 1B illustrate different views of the inventive subject matter. In this embodiment, the cup with parts has a part with a lip 10, a grip 12 and an aligned hole 14 incorporated into an encasing side wall 16, and a bottom 18. The figures show this part in flat form (FIG. 1A) for cost-advantageous shipping, and cup-shaped form (FIG. 1B) for use. Forming the part can be manual or by machine. The illustrated part is inexpensive to manufacture, purchase, and ship.

Figure 2A:
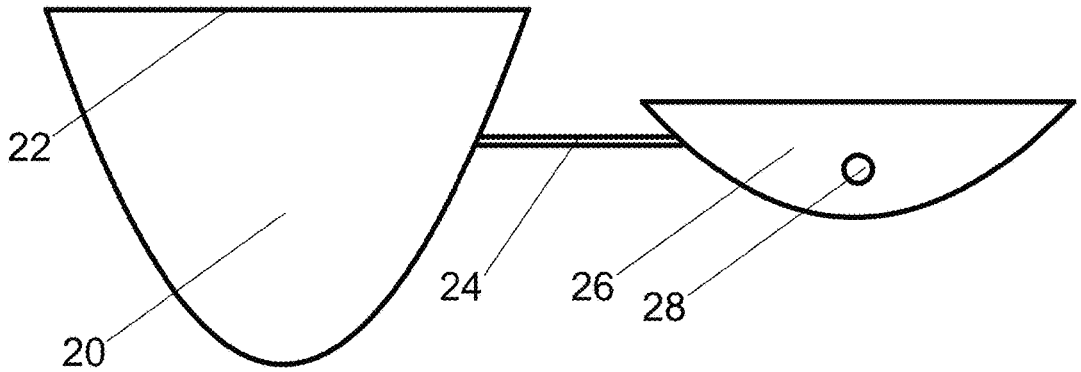
FIGS. 2A and 2B show a front and perspective views of another part of the inventive subject matter.
Figure 2B:
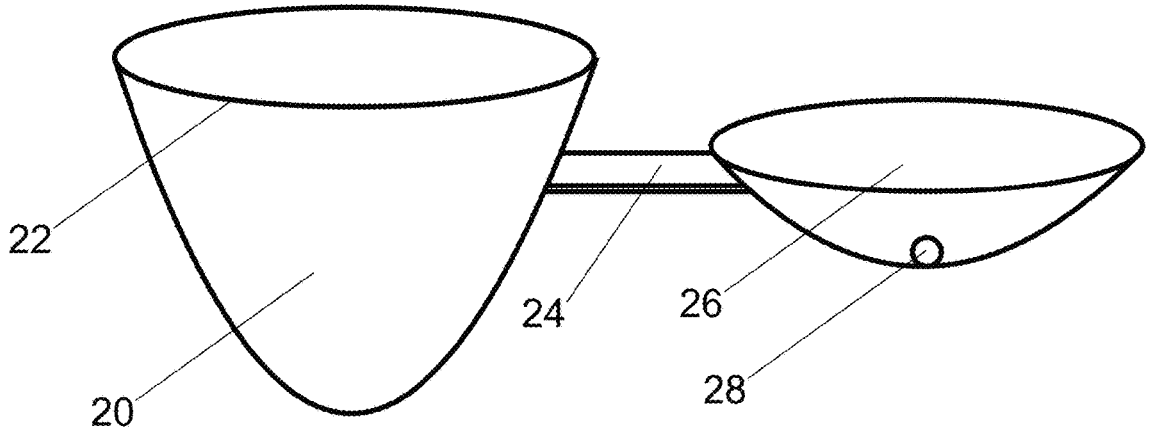
Figure 2C:
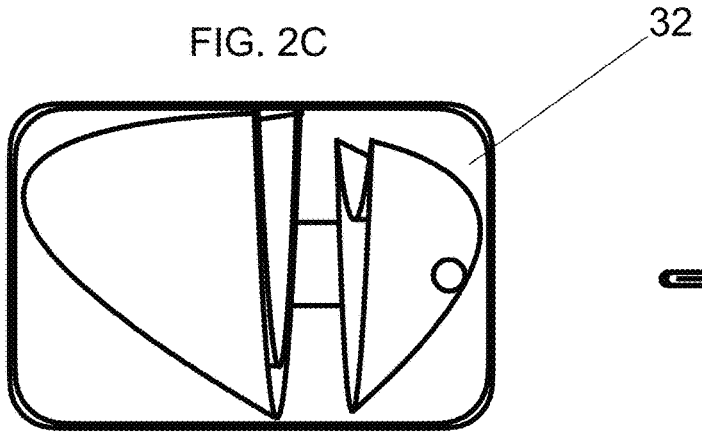
FIGS. 2C and 2D show a top and front views of another part of the inventive subject matter collapsed, folded, and packed for carrying and reuse.
Figure 2D:
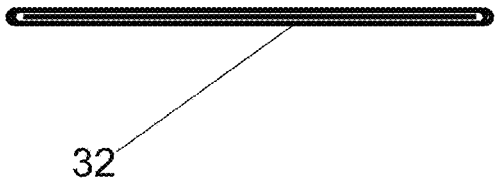

Now referring to FIGS. 2A & 2B that illustrate different views of the inventive subject matter. Shown is a part with a receptacle 20 that includes a rim 22 that utilizes a connecting band 24 to join with a lid 26 with a hole 28. When manufactured from pliable material, the illustrated part is light and durable. FIGS. 2C & 2D show the aforementioned part folded and flattened while encased in a thin carrying case 32 for circular economy reuse.

Figure 3:
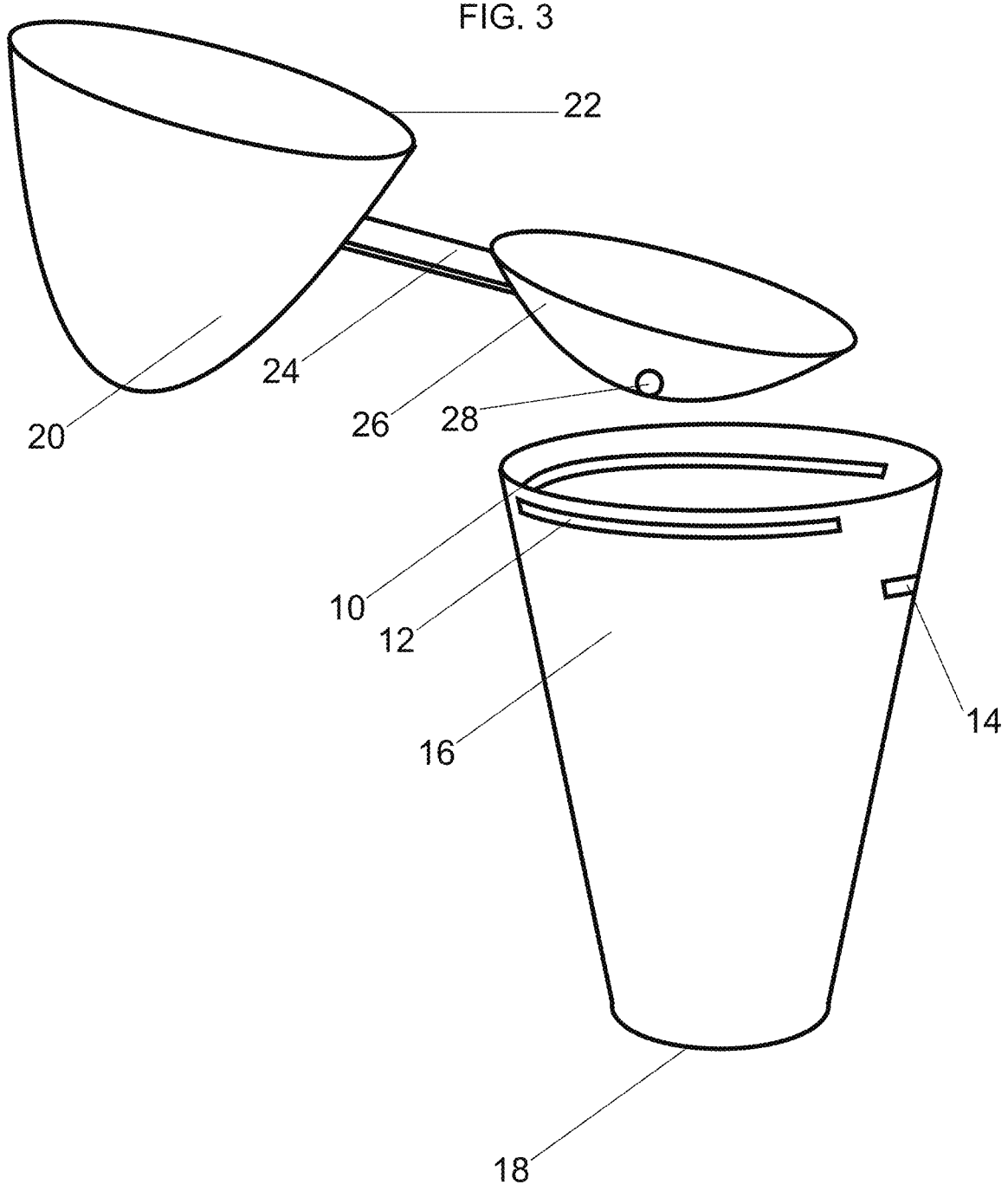
FIG. 3 shows perspective view of parts of the inventive subject matter beginning to be assembled by threading a lid and a connecting band through an aligned hole.
Figure 4A:
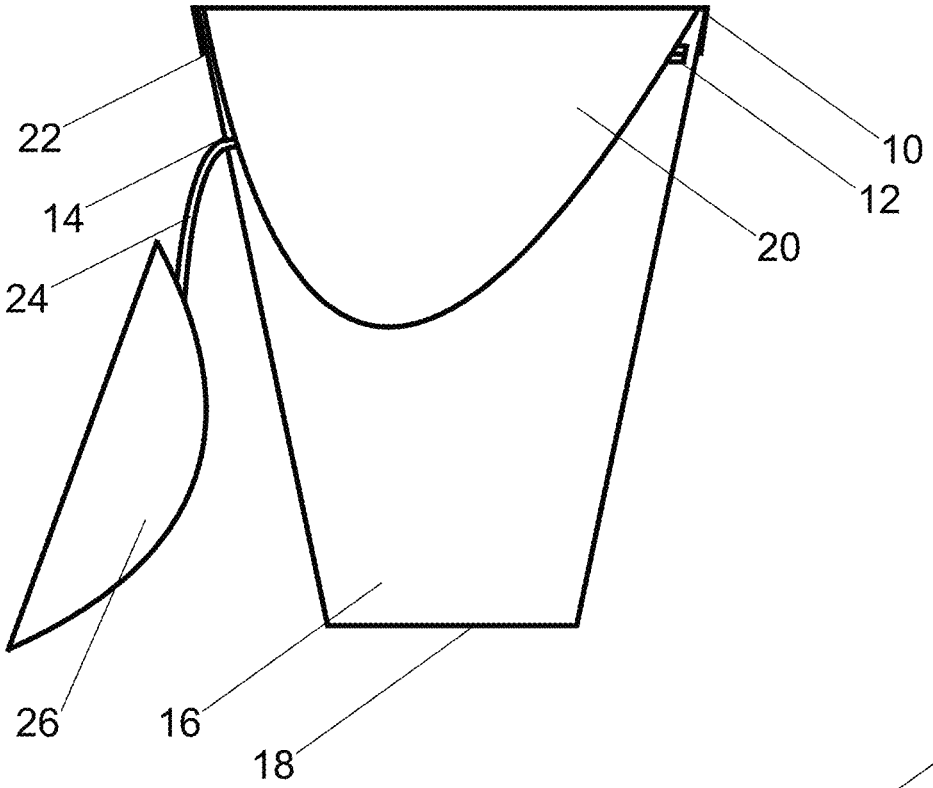
FIG. 4A shows a front cross-sectional view of parts of the inventive subject matter assembled by threading a lid and a connecting band through an aligned hole and folding a rim over a lip.
Figure 4B:
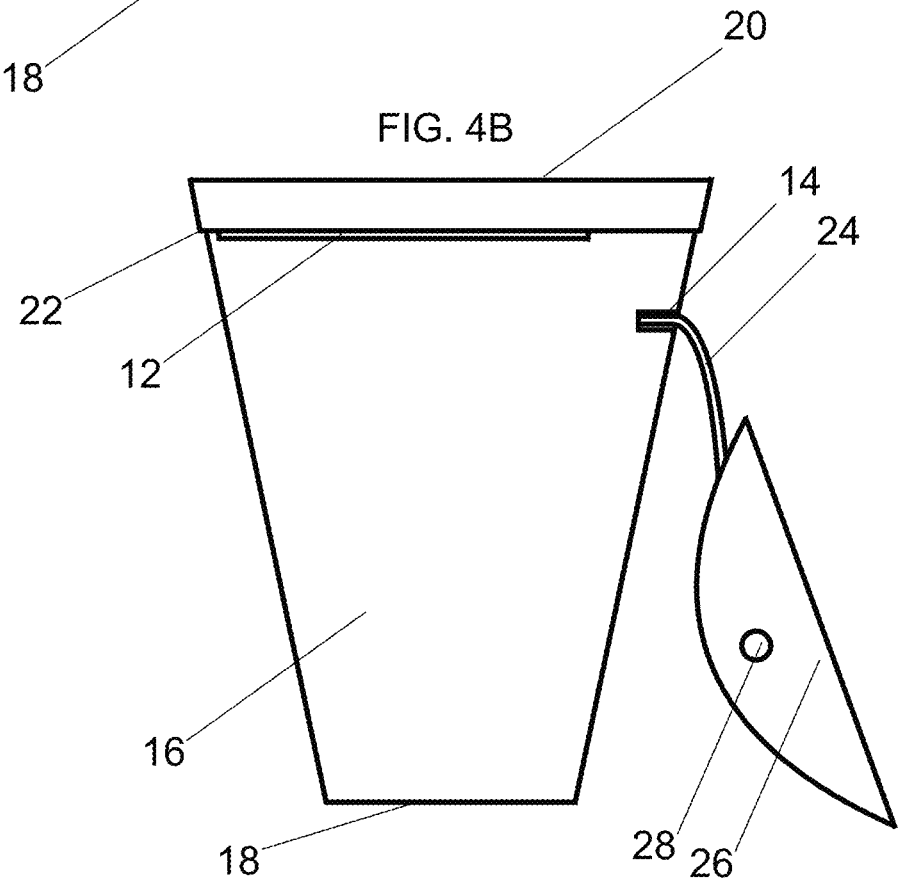
FIG. 4B shows a front view of parts of the inventive subject matter assembled by threading a lid and a connecting band through an aligned hole and folding a rim over a lip.

FIG. 3 illustrates the parts immediately before coming together to create a structure that functions as a disposable cup. A lid 26 with a hole 28 attached via a connecting band 24 to a receptacle 20 that includes a rim 22 is about to be threaded through an aligned hole 14 incorporated into an encasing side wall 16 below a lip 10 and a grip 12, and above a bottom 18. Using recyclable/reusable/biodegradable materials that are never permanently joined yet still function at or above comparable substitutes, makes the resulting disposable cup environmentally friendly. All the illustrated parts are simple to assemble by a layperson.

The steps to assemble the disposable cup embodied in FIGS. 1-3 are: 1. By hand or using a machine, form the cup shape by wrapping the encasing side wall 16 along the circumference of the bottom 18; 2. Thread the lid 26 with hole 28 through the aligned hole 14 and pull the connecting band 24 tight; 3. Fold the rim 22 of the receptacle 20 over the lip 10 so that it engages with the grip 12 to provide an impermanent yet strong bond between the parts; 4. Fill liquid into the receptacle 20; and 5. Fit the lid 26 over the folded rim 22 and the lip 10. Users drink through the hole 28. Pack up the liquid-retaining part in a carrying case 32 for reuse.

Figure 5A:
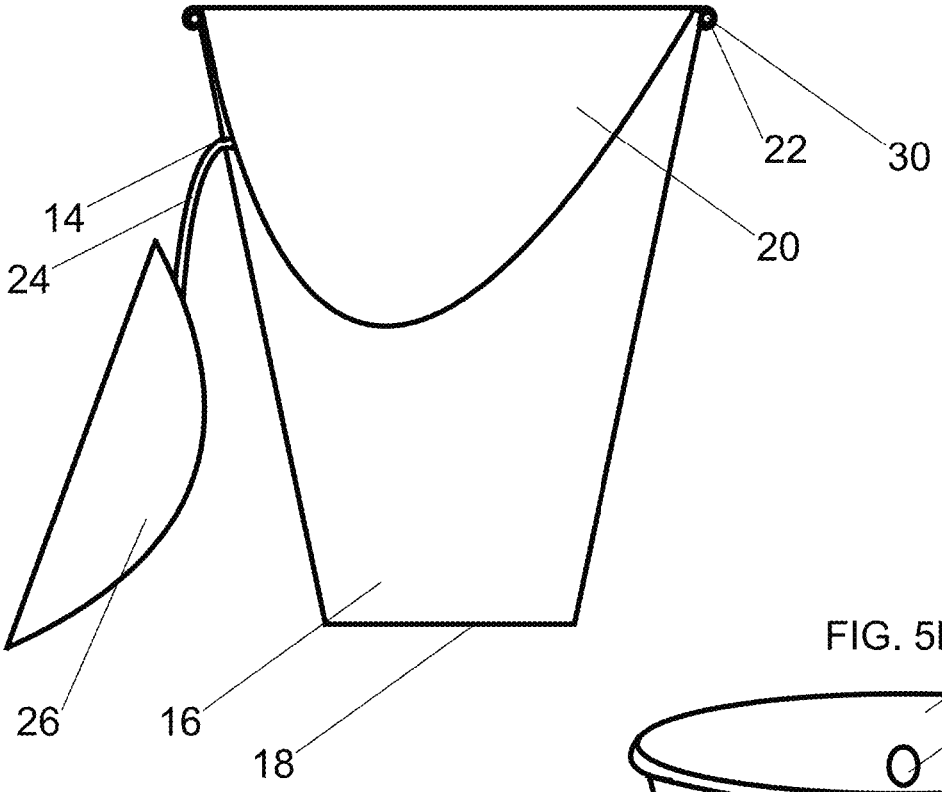
FIG. 5A shows a front cross-sectional view of parts of the inventive subject matter assembled by threading a lid and a connecting band through an aligned hole and folding a rim over a rolled lip.
Figure 5B:
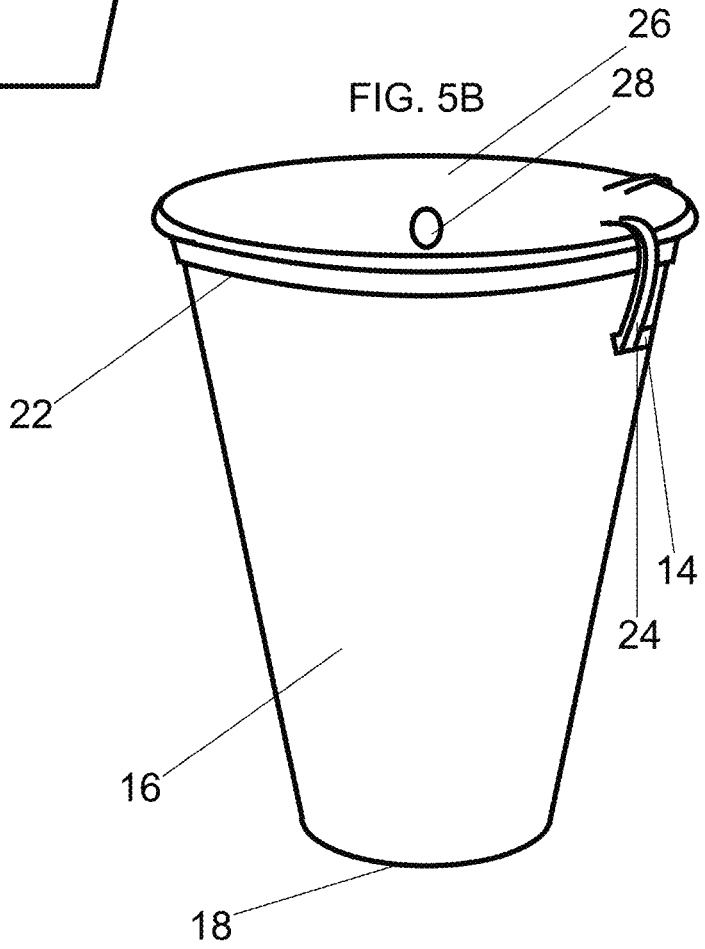
FIG. 5B shows a perspective view of parts of the inventive subject matter assembled by threading a lid and a connecting band through an aligned hole and folding a rim over a rolled lip, and then fitting a lid with a hole over the folded rim and the rolled lip.

FIGS. 4A, 4B, 5A & 5B illustrate different views of the inventive subject matter assembled. A lid 26 with a hole 28 attached to a connecting band 24 of one part is threaded through an aligned hole 14 along an encasing side wall 16 of another part in cup form (a bottom 18 is folded horizontally). A rim 22 of a receptacle 20 also attached to the connecting band 24 is folded over a lip 10 (FIGS. 4A & 4B) or a rolled lip 30 (FIGS. 5A & 5B) in order to provide a vessel for holding liquid. A grip 12, which is a cut-out in FIGS. 4A & 4B and the rolled lip 30 in FIGS. 5A & 5B, engages with the folded rim 22 to strengthen the hold between the joined parts. In FIG. 5B, the lid 26 is fitted over the folded rim 22 and the lip 10. The hole 28 is for drinking.

Figure 6A:
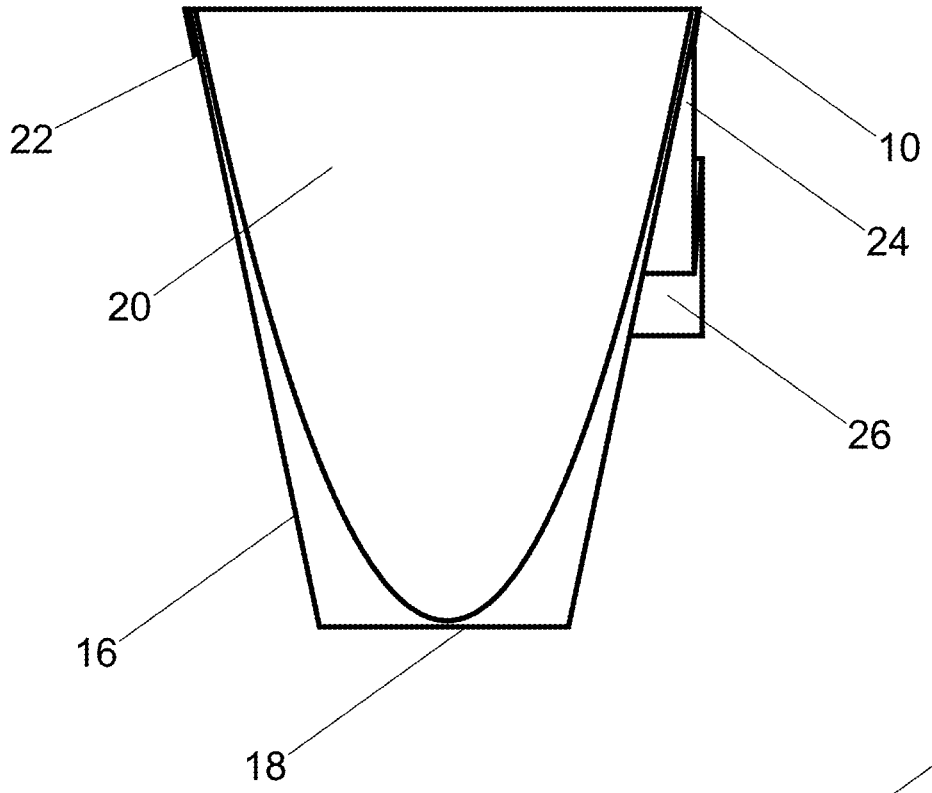
FIG. 6A shows a front cross-sectional view of parts of an additional embodiment of the inventive subject matter assembled by folding a rim over a lip.
Figure 6B:
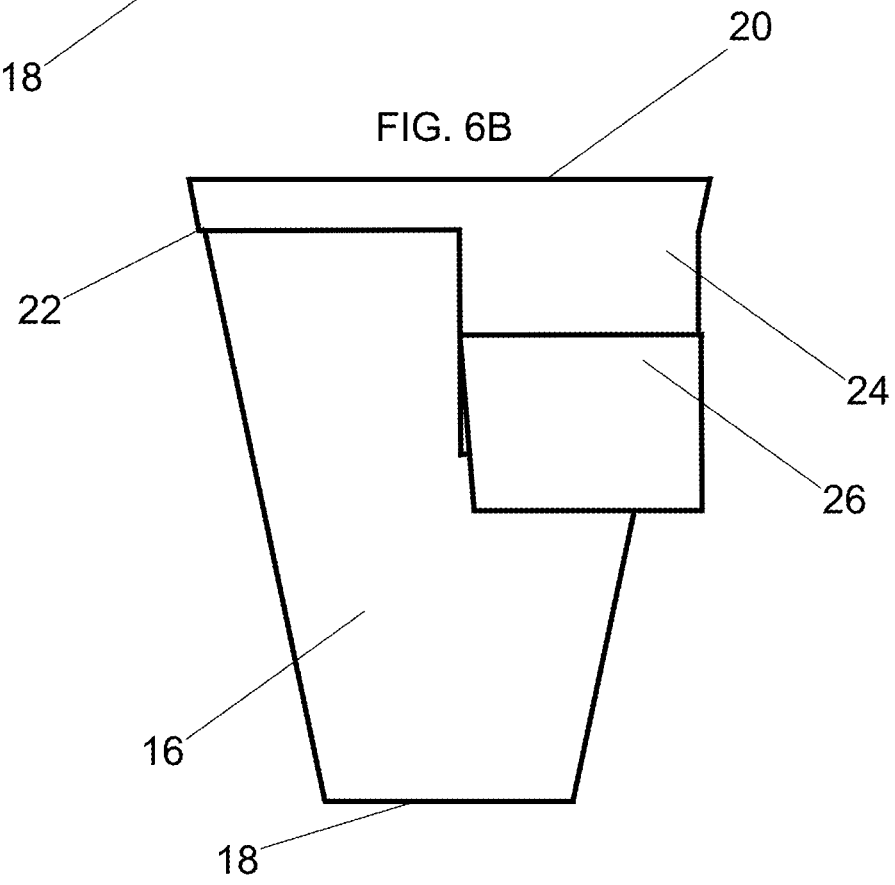
FIG. 6B shows a front view of parts of an additional embodiment of the inventive subject matter assembled by folding a rim over a lip.
Figure 6C:
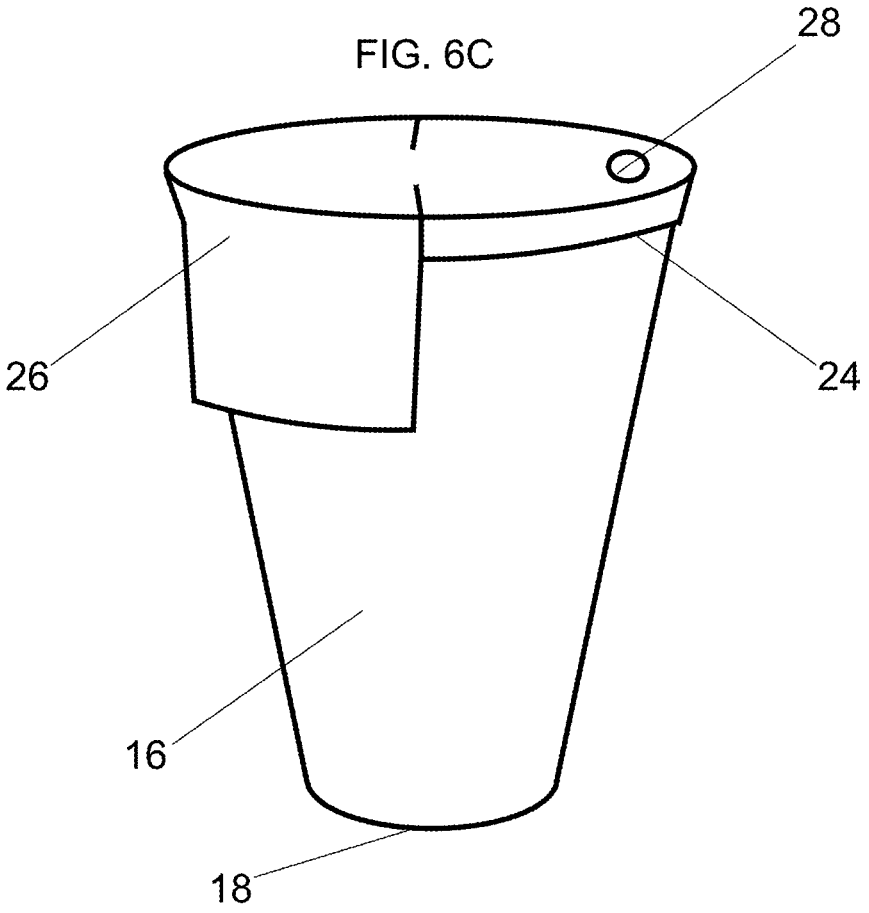
FIG. 6C shows a perspective view of parts of an additional embodiment of the inventive subject matter assembled by folding a rim over a lip, and then fitting a lid with a hole over the folded rim and the lip.
Figure 7A:
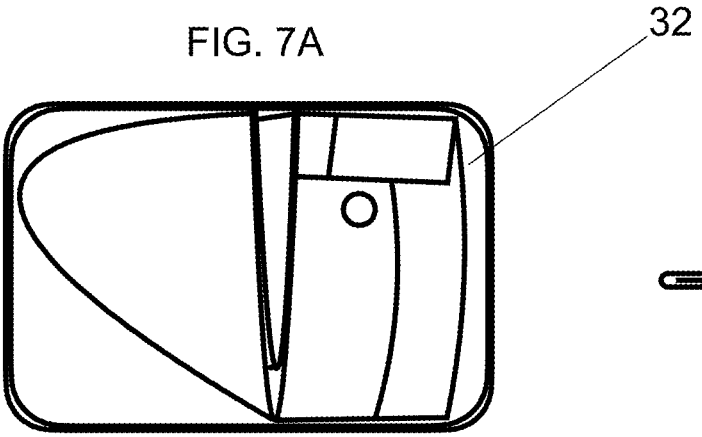
FIGS. 7A and 7B show a top and front views of a part of an additional embodiment of the inventive subject matter collapsed, folded, and packed for carrying and reuse.
Figure 7B:
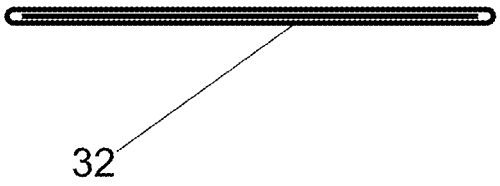

FIGS. 6A, 6B & 6C illustrate different views of an additional embodiment of the inventive subject matter assembled. A receptacle 20 with a rim 22 of one part is inserted into another part in cup form (a lip 10 atop an encasing side wall 16 and a bottom 18 folded horizontally). A lid 26 with a hole 28 is attached to the receptacle 20 via a connecting band 24. The rim 22 of the receptacle 20 is folded over the lip 10 in order to provide a vessel for holding liquid. In FIG. 6C, the lid 26 is fitted over the folded rim 22 and the lip 10. The hole 28 is for drinking. FIGS. 7A & 7B show the liquid-retaining part folded and flattened while encased in a thin carrying case 32 for circular economy reuse.

The steps to assemble the disposable cup embodied in FIG. 6 are: 1. By hand or using a machine, form the cup shape by wrapping the encasing side wall 16 along the circumference of the bottom 18; 2. Insert the receptacle 20 into this cup shape; 3. Fold the rim 22 of the receptacle 20 over the lip 10; 4. Fill liquid into the receptacle 20; and 5. Fit the lid 26 over the folded rim 22 and the lip 10. Users drink through the hole 28. Pack up the liquid-retaining part in a carrying case 32 for reuse.

Additional claims may be as follow:

1. A disposable cup assembly comprising:
   an encasing part including:
   i) a bottom;
   ii) an encasing side wall extending upwardly from the bottom and having an aligned hole;
   iii) a lip located at an upper edge of the encasing side wall; and
   iv) a grip integrated into the encasing side wall;
   a liquid-retaining part including:
   i) a receptacle having a rim; and
   ii) a lid having a hole, the lid being attached to the receptacle via a connecting band,
   wherein the lid is configured to be threaded through the aligned hole in the encasing side wall and the rim of the receptacle is foldable over the lip of the encasing part to secure the liquid-retaining part within the encasing part.
2. The disposable cup assembly of claim 1, wherein the grip is a cut-out in the encasing side wall designed to engage with the folded rim of the receptacle to provide a secure connection.
3. The disposable cup assembly of claim 1, wherein the lip is a rolled lip to enhance the engagement between the folded rim of the receptacle and the encasing part.
4. The disposable cup assembly of claim 1, wherein the parts are formed from recyclable, reusable, or biodegradable materials.
5. The disposable cup assembly of claim 1, further comprising a carrying case configured to encase the folded and flattened liquid-retaining part for storage and transport.
6. A method of assembling a disposable cup, the method comprising: forming a cup shape by wrapping an encasing side wall around a bottom; threading a lid with a hole, which is attached to a receptacle via a connecting band, through an aligned hole in the encasing side wall; pulling the connecting band tight to secure the lid in place; folding a rim of the receptacle over a lip of the encasing side wall to secure the receptacle within the encasing side wall; filling the receptacle with liquid; and fitting the lid over the folded rim and the lip, wherein the hole in the lid is for drinking.

7. The method of claim 6, further comprising packing the liquid-retaining part in a carrying case for reuse after use.
8. The method of claim 6, wherein the parts are made from materials that are recyclable, reusable, or biodegradable.
9. The method of claim 6, wherein the grip is used to enhance the engagement between the folded rim of the receptacle and the encasing side wall.
10. The method of claim 6, wherein the lip is a rolled lip that provides an improved seal and connection between the parts.
11. A disposable cup assembly comprising: an encasing part including: i) a bottom; ii) an encasing side wall extending upwardly from the bottom; and iii) a lip located at an upper edge of the encasing side wall; a liquid-retaining part including: i) a receptacle having a rim; and ii) a lid having a hole, the lid being attached to the receptacle via a connecting band, wherein the receptacle is insertable into the encasing side wall and the rim of the receptacle is foldable over the lip to secure the receptacle within the encasing part.

The liquid-retaining part of the cup with parts can be manufactured from any material that is suitable for containing consumable liquids and is recyclable/reusable/biodegradable. A few examples of many acceptable materials are natural latex, silicone rubber, or vytex.

All patent and non-patent literature cited herein is hereby incorporated by reference in its entirety for all purposes.

I claim:

1. A cup with parts apparatus that can be configured as a single-use beverage cup comprising:
- a part formed by hand or using a machine into a cup shape constructed of an aligned hole within an encasing wall in between a lip and a grip above and a bottom below;
- a part constructed of a receptacle with a rim attached via a connecting band to a lid with a hole;
- a container is configured as a single-use beverage cup by threading the lid with the hole through the aligned hole such that the connecting band holds the receptacle in place, and the rim is folded down over the lip and engages with the grip, and the lid is stretched over the rim and the lip;
- the hole is used for drinking;
- the parts (singularly or both) can be packed-up for reuse;
- the container fabricated from any material used for food and beverage containment.

2. The cup with parts apparatus as described in claim 1 where:
- the container is fabricated from materials that are both environmentally friendly (recyclable/reusable/biodegradable) and used for food and beverage containment.

3. A cup with parts apparatus that can be configured as a single-use beverage cup comprising:
- a part formed by hand or using a machine into a cup shape constructed of an encasing wall in between a lip above and a bottom below;
- a part constructed of a receptacle with a rim attached via a connecting band to a lid with a hole;
- a container is configured as a single-use beverage cup by inserting the receptacle into the cup shape constructed of the encasing wall, and the rim is folded down over the lip, and the lid is fitted over the rim and the lip;
- the hole is used for drinking;
- the parts (singularly or both) can be packed-up for reuse;
- the container fabricated from any material used for food and beverage containment.

4. The cup with parts apparatus as described in claim 3 where:
- the container is fabricated from materials that are both environmentally friendly (recyclable/reusable/biodegradable) and used for food and beverage containment.

5. A cup with parts assembly method for a single-use beverage cup comprising:
- procure a cup-shaped form assembled by hand or using machine with a lip at the top, a bottom at the bottom, and an encasing wall in between;
- thread a lid with a hole through the aligned hole(s) and pull so that a connecting band that attaches to a receptacle and a rim is in place;
- fit together with a receptacle with a rim and a connecting band that attaches to a lid;
- fold the rim over the lip;
- fill the receptacle with desired contents;
- fit the lid with the hole over the folded rim and the lip; drink via the hole;
- (optional) pack up the receptacle part for reuse;
- (optional) pack up the cup-shaped part for reuse.

6. The cup with parts assembly method as described in claim 5, further comprising packing up the receptacle part for reuse.

7. The cup with parts assembly method as described in claim 6, further comprising pack up the cup-shaped part for reuse.

* * * * *